US006227044B1

(12) United States Patent
Jarvis

(10) Patent No.: US 6,227,044 B1
(45) Date of Patent: May 8, 2001

(54) METHODS AND APPARATUS FOR DETECTING TORSIONAL VIBRATION IN A BOTTOMHOLE ASSEMBLY

(75) Inventor: Brian Peter Jarvis, Chipping Sodbury (GB)

(73) Assignee: Camco International (UK) Limited, Stonehouse (GB)

( * ) Notice: Subject to any disclaimer, the term of this patent is extended or adjusted under 35 U.S.C. 154(b) by 0 days.

(21) Appl. No.: 09/405,830

(22) Filed: Sep. 24, 1999

(30) Foreign Application Priority Data

Nov. 6, 1998 (GB) ..... 9824248

(51) Int. Cl.[7] ..... E21B 47/00; E21B 44/00; E21B 41/00

(52) U.S. Cl. ..... 73/152.47; 73/152.58; 175/40; 175/56; 166/250.1

(58) Field of Search ..... 73/152.47, 152.43, 73/152.46, 152.58, 152.16; 166/250.01, 250.13; 175/56, 40, 39

(56) References Cited

U.S. PATENT DOCUMENTS

| | | | | |
|---|---|---|---|---|
| 3,703,096 | * | 11/1972 | Vitter, Jr. et al. | 73/151 |
| 4,150,568 | | 4/1979 | Berger et al. | 73/151 |
| 4,471,663 | | 9/1984 | Wallace | 73/862.35 |
| 4,685,329 | | 8/1987 | Burgess | 73/151 |
| 4,695,957 | | 9/1987 | Peltier | 364/422 |
| 4,715,451 | | 12/1987 | Bseisu et al. | 175/40 |
| 4,773,263 | | 9/1988 | Lesage et al. | 73/151 |
| 4,903,245 | * | 2/1990 | Close et al. | 367/81 |
| 4,928,521 | | 5/1990 | Jardine | 73/151 |
| 5,077,697 | * | 12/1991 | Chang | 367/31 |
| 5,138,875 | | 8/1992 | Booer | 73/151 |
| 5,141,061 | | 8/1992 | Henneuse | 175/56 |
| 5,205,163 | | 4/1993 | Sananikone | 73/151 |
| 5,226,332 | * | 7/1993 | Wassell | 73/151 |
| 5,245,871 | | 9/1993 | Henneuse et al. | 73/151 |
| 5,273,122 | | 12/1993 | Henneuse | 175/26 |
| 5,313,829 | | 5/1994 | Paslay et al. | 73/151 |
| 5,321,981 | * | 6/1994 | Macpherson | 73/151 |
| 5,402,677 | | 4/1995 | Paslay et al. | 73/151 |
| 5,448,911 | | 9/1995 | Mason | 73/151 |
| 5,464,736 | | 11/1995 | Helber et al. | 430/581 |
| 5,721,376 | * | 2/1998 | Pavone et al. | 73/152.47 |
| 5,864,058 | | 1/1999 | Chen-Kang | 73/152.47 |
| 5,999,891 | | 12/1999 | Rey-Fabret et al. | 702/151 |
| 6,065,332 | * | 5/2000 | Dominick | 73/152.47 |
| 6,142,228 | * | 11/2000 | Joqi et al. . | |

FOREIGN PATENT DOCUMENTS

| | | |
|---|---|---|
| 0 155 368 | 4/1987 | (EP) . |
| 0 465 731 | 7/1990 | (EP) . |
| 0 465 731 | 1/1992 | (EP) . |
| 63-144781 | 6/1988 | (JP) . |

OTHER PUBLICATIONS

Translated Abstract of JP 63144781 obtained electronically from Derwent World Patents Index, via the Dialog Corporation, on May 2, 2000.

* cited by examiner

*Primary Examiner*—Hezron Williams
*Assistant Examiner*—David Wiggins
(74) *Attorney, Agent, or Firm*—Jeffrey E. Daly

(57) ABSTRACT

The invention provides a method of detecting, at the surface, the occurrence of torsional vibration in a bottomhole assembly mounted on the drill string of a rotary drilling system. The method includes the steps of: ascertaining natural frequencies of torsional vibration of the bottomhole assembly prior to drilling, and noting at least one reference frequency for an integer wavelength mode of torsional vibration of the bottomhole assembly. During subsequent drilling, the drill string mean square torque at the surface is monitored for a bandwidth around the reference frequency. It is found that peaks in the mean square torque, close to the reference frequency, are indicative of the occurrence of torsional vibration in the bottomhole assembly.

12 Claims, 5 Drawing Sheets

METHODS AND APPARATUS FOR DETECTING TORSIONAL VIBRATION IN A BOTTOMHOLE ASSEMBLY

BACKGROUND OF THE INVENTION

1. Field of the Invention

The invention relates to methods and apparatus for detecting torsional vibration in a bottomhole assembly mounted on the drill string of a rotary drilling system for drilling in an earth formation. As is well known, a rotary drilling system is a system in which the bottomhole assembly, including the drill bit, is mounted on a drill string which extends downhole and is rotated from the surface.

2. Description of Related Art

The invention is particularly, but not exclusively, applicable to bottomhole assemblies including rotary drag-type drill bits of the kind comprising a bit body having a shank for connection to a drill collar on a drill string, a plurality of cutters mounted on the bit body, and means for supplying drilling fluid to the surface of the bit body to cool and clean the cutters and to carry cuttings to the surface. In one common form of bit some or all of the cutters are preform (PDC) cutters each comprising a tablet, usually circular or part-circular, made up of a superhard table of polycrystalline diamond, providing the front cutting face of the element, bonded to a substrate, which is usually of cemented tungsten carbide.

While such PDC bits have been very successful in drilling relatively soft formations, they have been less successful in drilling harder formations or soft formations which include harder occlusions or stringers. Although good rates of penetration are possible in harder formations, the PDC cutters may suffer accelerated wear and bit life can be too short to be commercially acceptable.

Studies have suggested that the rapid wear of PDC bits in harder formations can be due to damage of the cutters as a result of impact loads caused by torsional vibration of the bottomhole assembly.

Torsional vibration can have the effect that cutters on the drill bit may momentarily stop or be rotating backwards, i.e. in the reverse rotational direction to the normal forward direction of rotation of the drill bit during drilling. This is followed by a period of forward rotation of up to twice the RPM mean value. It is believed that it is this behaviour which may be causing excessive damage to the cutters of PDC bits when drilling harder formations where torsional vibration is more likely to occur. The effect of reverse rotation on a PDC cutter may be to impose unusual loads on the cutter which tend to cause spalling or delamination, i.e. separation of part or all of the polycrystalline diamond facing table from the tungsten carbide substrate.

If it is known that torsional vibration is occurring in the bottomhole assembly, it may be possible for the operator of the rotary drilling system, at the surface, to reduce or stop the vibration by modifying the drilling parameters, for example by changing the speed of rotation of the drill string (RPM) and/or the weight-on-bit (WOB). However, it has hitherto been difficult to detect at the surface torsional vibration which is occurring in the bottomhole assembly, since many different frequencies of vibration may be transmitted to the surface and the high frequency vibrations become very attenuated as they pass upwardly along the drill string so that the amplitudes are much reduced at the surface. Accordingly, it has not been reliably possible, hitherto, to detect the onset of torsional vibration of the bottomhole assembly (except very low frequency vibrations which are dependent on depth) by monitoring general torque levels at the surface. It is possible to monitor torsional vibration of the bottomhole assembly by sensors located downhole, in the assembly itself, and transmitting signals from the downhole sensors to the surface. While this may be done in test rigs, it is not generally a practical proposition in commercial drilling.

It would therefore be desirable to be able to monitor torque vibration in the drill string, at the surface, in such a manner that the presence of torsional vibration in the bottomhole assembly can be detected at the surface, and it is this problem which the present invention sets out to solve.

The present invention is based on the realization that the frequencies of torsional vibrations of a bottomhole assembly are associated with the natural resonance frequencies of the drill collars and other components of the bottomhole assembly, and particularly in the modes which involve integer wavelengths, e.g. one or two full wavelengths, of the bottomhole assembly only. The frequencies of these modes can be calculated from the geometry of the bottomhole assembly alone and do not depend on local drilling parameters. The present invention is therefore based on the concept of monitoring at the surface only those frequencies which are in the region of the natural frequencies of the bottomhole assembly.

SUMMARY OF THE INVENTION

According to the invention, therefore, there is provided a method of detecting torsional vibration in a bottomhole assembly mounted on a drill string of a rotary drilling system for drilling in an earth formation, the method including the steps of:

(a) ascertaining natural frequencies of torsional vibration of the bottomhole assembly prior to drilling, (b) noting at least one reference frequency for an integer wavelength mode of torsional vibration of the bottomhole assembly, and (c) during subsequent drilling, monitoring the drill string torque at or near the surface for a bandwidth around said reference frequency.

Thus, if the monitoring at the surface detects significant vibration of the drill string at a frequency corresponding to a pre-ascertained natural frequency of the bottomhole assembly, it may be inferred that torsional vibration of the bottomhole assembly is occurring. Alternatively, if the amplitude of the detected torsional vibration is not significant, it may be monitored over time so that any significant increase in the torsional vibration at the reference frequency may be noted. The operator may then take steps to reduce or eliminate the downhole torsional vibration by modifying one or more drilling parameters such as RPM or WOB.

Preferably, the natural frequencies of torsional vibration of the bottomhole assembly are ascertained by use of a computer program which determines the natural frequencies of an assembly from input of parameters of the assembly, such as dimensions, mass, rotary inertia and flexibility of the assembly or components thereof. However, it will be appreciated that the natural frequencies might also be ascertained by other means, for example by physical testing of the actual bottomhole assembly itself.

The monitoring of the surface torque of the drill string may be effected by coupling a surface torque sensor to the drill string and transmitting the output signal from the torque sensor to a computer which has been programmed to analyze the signal and produce an output indicating variation of the torque for a bandwidth around the aforesaid pre-ascertained reference frequency of the bottomhole assembly, said reference frequency having previously been input as a parameter into the signal analyzing program of the computer.

The output signal from the surface torque sensor may be digitally sampled by the computer program for a succession of short periods. The signal is preferably sampled at a rate of at least 300 Hz. The output signal may be an analogue signal which is digitized before being transmitted to the computer.

The method may include the further step of producing a spectral density function from each sampled signal, identifying that part of the function lying within a selected narrow bandwidth around said reference frequency of the bottomhole assembly, and monitoring that part of the function over time. For example, the area under the function lying within said selected narrow bandwidth may be calculated and the value of that area monitored over time.

Thus, the area of the spectral density function within the selected bandwidth may be plotted against time on a visual output from the computer, e.g. on a visual display or print-out. Changes in the value over time may then give warning of the onset of torsional vibration in the bottomhole assembly, or indicate its successful elimination.

The invention also provides means for carrying out the above methods, comprising a surface torque sensor for coupling to the drill string at or near the surface, and means for transmitting an output signal from the torque sensor to a computer, the computer being programmed to analyze the signal and produce an output indicating variation of the mean square torque for a bandwidth around a reference frequency previously input as a parameter into the signal analyzing program of the computer.

The output from the surface torque sensor may be an analogue torque signal, an analogue-digital converter being provided to digitize said output signal and transmit a corresponding digital signal to the computer.

DETAILED DESCRIPTION OF THE PREFERRED EMBODIMENTS

Figure 1:
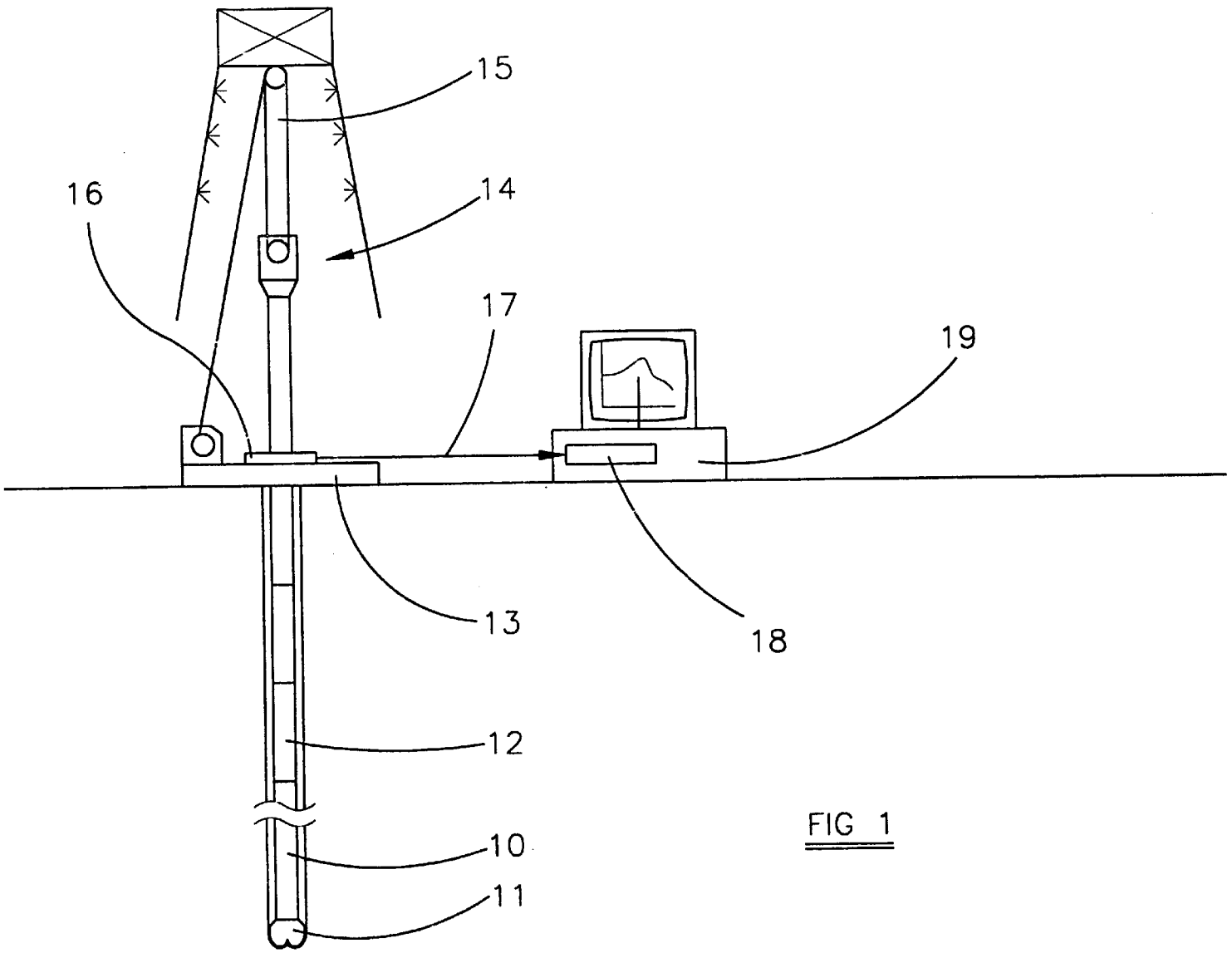
FIG. 1 shows diagrammatically a system for monitoring, at the surface, torsional vibrations transmitted to the surface from the bottomhole assembly of a rotary drilling system.

FIG. 1 shows diagrammatically a system for monitoring torsional vibrations transmitted to the surface from the bottomhole assembly of a rotary drilling system. The bottomhole assembly 10 of the drilling system includes a drill bit 11 and is connected to the lower end of a drill string 12 which extends to the surface and is rotatably driven from the surface by a rotary table 13 on a drilling rig 14. The rotary table 13 is driven by a drive motor (not shown) and raising and lowering of the drill string, and application of weight-on-bit (WOB), is under the control of draw works indicated diagrammatically at 15.

As is well known, the bottomhole assembly will include, in addition to the drill bit, a variety of other possible components such as drill collars, stabilizers, steering equipment, MWD (measurement-while-drilling) equipment, etc. The particular nature of such components does not form part of the present invention and the various types of component will not therefore be described in detail, being well known to those skilled in this art.

As previously explained, during drilling the drill string and bottomhole assembly may be subject to torsional vibration, and FIG. 1 also shows apparatus for monitoring the vibrations which are transmitted to the surface along the drill string.

The apparatus comprises a torque sensor 16 which is coupled to the upper end of the drill string 12 and transmits an analogue signal 17, representative of drill string torque, to an analogue-digital converter 18. The digitized torque signal is then passed to a computer 19 which has been programmed to analyze the signal and produce an output indicating variation of torque with time, for example by sampling the torque signal for a succession of short periods. The signal is preferably sampled at a rate of at least 300 Hz.

Figure 2:
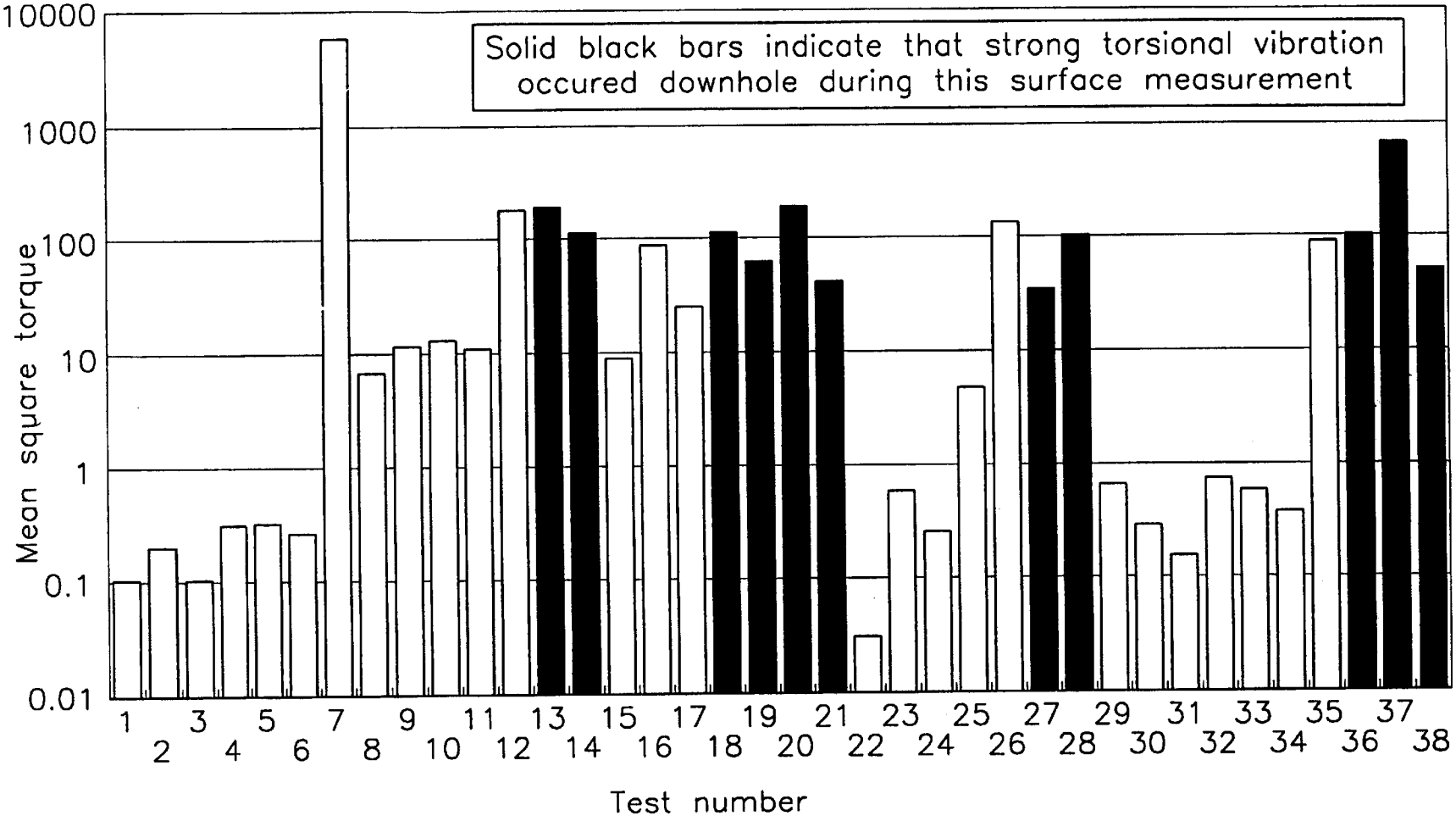
FIG. 2 shows the mean square surface torque vibration levels in a particular rotary drilling system, for a broad frequency range.

The computer calculates the mean square torque for each sampling period, and FIG. 2 shows the values of mean square torque for a number of successive samplings over a broad frequency range. This figure demonstrates the difficulty of detecting torsional vibration of the bottomhole assembly by this method.

During the test shown in FIG. 2, the bottomhole assembly itself incorporated a downhole sensor to detect torsional vibration of the bottomhole assembly directly. Signals from the downhole sensor were stored in a memory, also located downhole, and the contents of the memory were analyzed after completion of the test and withdrawal of the drilling system from the hole. The results of the downhole readings of torsional vibration were then superimposed on the surface readings of mean square torque for comparison purposes. In FIG. 2 the surface readings taken at times when the bottomhole assembly was actually experiencing torsional vibration (as detected by the downhole sensor) are shown in solid black. It will be seen that the peak levels of mean square torque, measured at the surface, do not necessarily occur at times when torsional vibration was occurring downhole. Thus, when total mean square torque is calculated for a wide band of frequencies there is no apparent correlation between the readings taken at the surface and the occurrence of torsional vibration of the bottomhole assembly.

Accordingly, taking surface measurements in this way does not allow any inference that a peak in mean square torque for all frequencies, measured at the surface, corresponds to a period of significant torsional vibration downhole.

Figure 3:
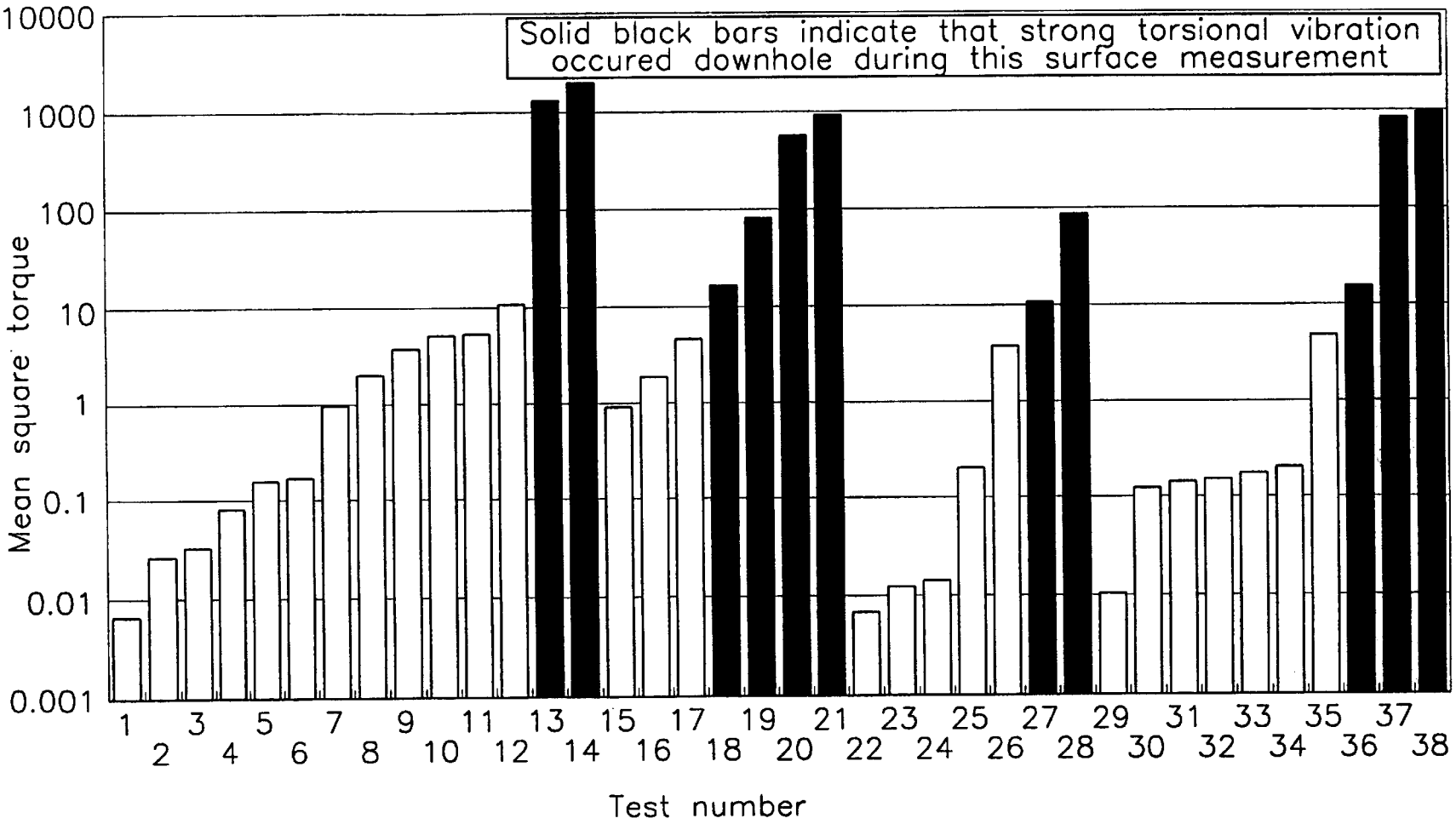
FIG. 3 shows the same vibration levels reduced to those frequencies close to the resonant frequency of the bottomhole assembly.

FIG. 3, however, shows monitoring of the output from the surface torque sensor in accordance with the present invention.

As a first step, physical details of the bottomhole assembly, i.e. parameters such as dimensions, mass rotary inertia, and flexibility of the drill collar sections or other bottomhole components, are fed into a computer program designed to calculate the torsional natural frequencies of the bottomhole assembly, assuming free end conditions. The frequencies for integer wavelength modes are then noted. In the case of the system being tested in FIG. 2 a natural frequency of 18 Hz was noted.

Accordingly, in the plots of FIG. 3, the mean square torque for each surface measurement is calculated only in a narrow bandwidth around 18 Hz, e.g. between 16.5 Hz and 20.5 Hz, and not for a full range of frequencies. In FIG. 3 this value is then plotted against time in the same manner as in FIG. 2, the readings corresponding to bursts of torsional vibration of the bottomhole assembly being again shown in solid black. It will be seen that there is now an evident correlation between peaks in the mean square torque, based on the surface measurements, and the actual bursts of torsional vibration measured downhole. If more frequent samples of the surface torque are taken, then the agreement will be even closer. Accordingly, monitoring the surface torque in this way, i.e. effectively applying a filter of narrow bandwidth around a pre-ascertained reference frequency, allows downhole torsional vibration to be detected at the surface, so that the operator of the drilling system may then take appropriate steps to reduce the downhole vibration, for example by varying RPM and/or WOB, and may see from continued monitoring of the surface torque whether the steps taken have been successful in reducing the downhole vibration.

Figure 4:
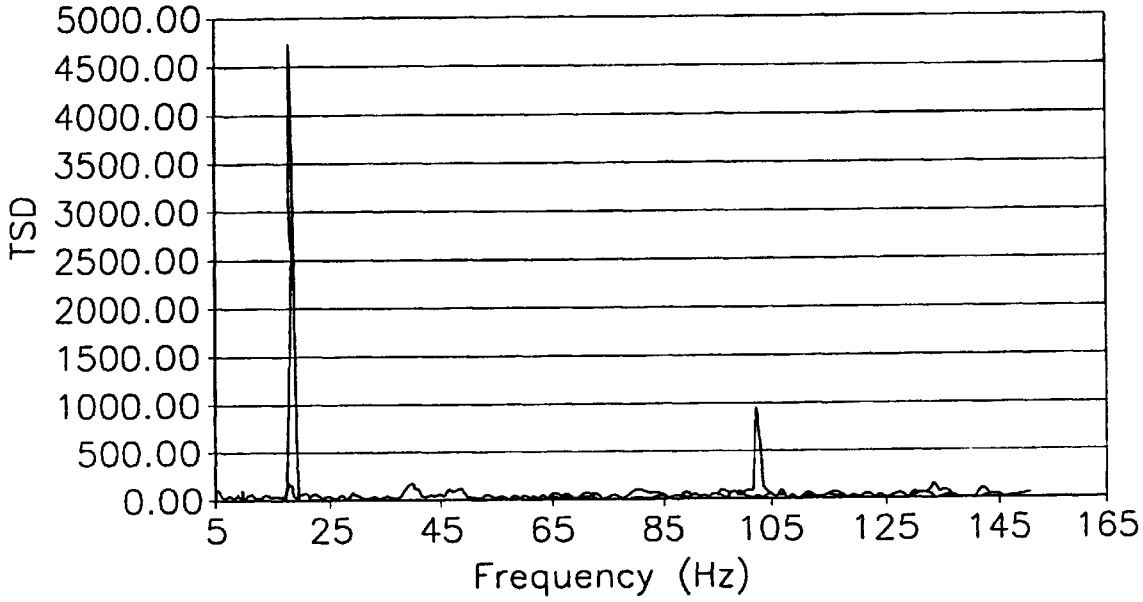
FIG. 4 is a plot of torque spectral density of surface torque measurements.

In a specific method according to the invention, the surface torque sensor 11 supplies an analogue signal to the analogue-digital converter 18, which supplies a digital signal to the computer, which is fitted with a data acquisition card. As before, the computer is programmed to sample the analogue signal at a rate of at least 300 Hz for successive periods, each of a few seconds. According to one particular method of the invention, the spectral density function is then produced, as shown for example in FIG. 4, which illustrates a typical spectral density function for one sampling period. It will be seen that this shows a spike at around 18 Hz, indicating the presence of some torsional vibration downhole at around that frequency. In order to monitor the downhole torsional vibration, the computer program calculates the area of the spectral density function for a bandwidth of a few Hz, for example about 4 Hz, around the 18 Hz frequency or other reference frequency for an integer wavelength mode of torsional vibration of the particular bottomhole assembly being used. This value may then be plotted on a rolling time axis which may be displayed on a Visual Display Unit (VDU) or print-out to show the system operator any changes that occur with time. By monitoring this visual output, the operator may determine whether torsional vibration is occurring downhole and may see the response to his modification of drilling parameters in an effort to reduce such vibration. All values would be stored in a log for later analysis. One sampling period every few seconds should be sufficient to give the operator ample warning of the onset of torsional vibration.

Figure 5:
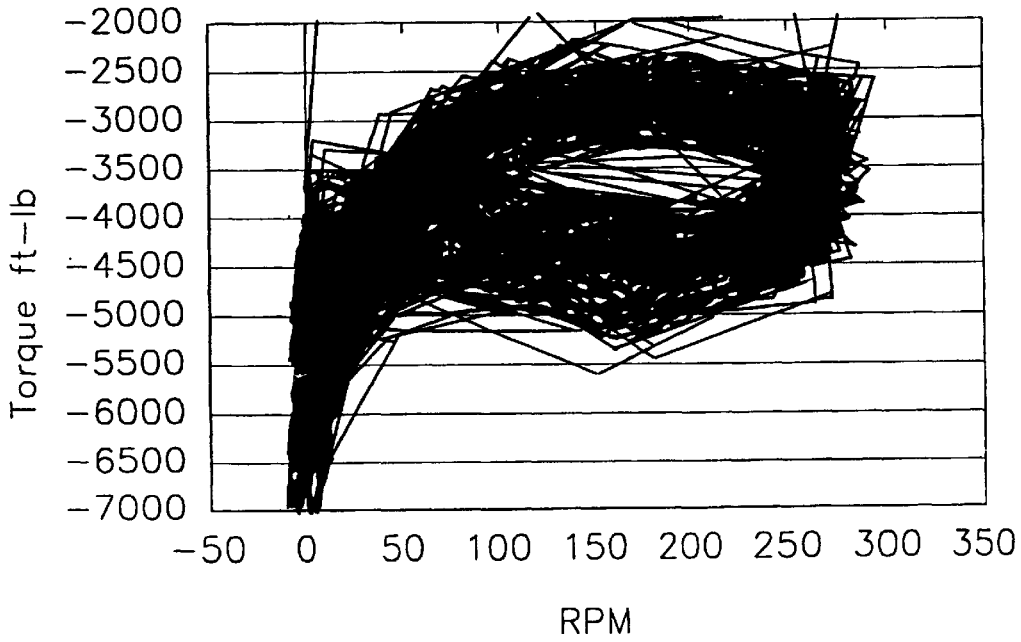
FIG. 5 is a plot of torque against RPM for a rotary drilling assembly.
Figure 6:
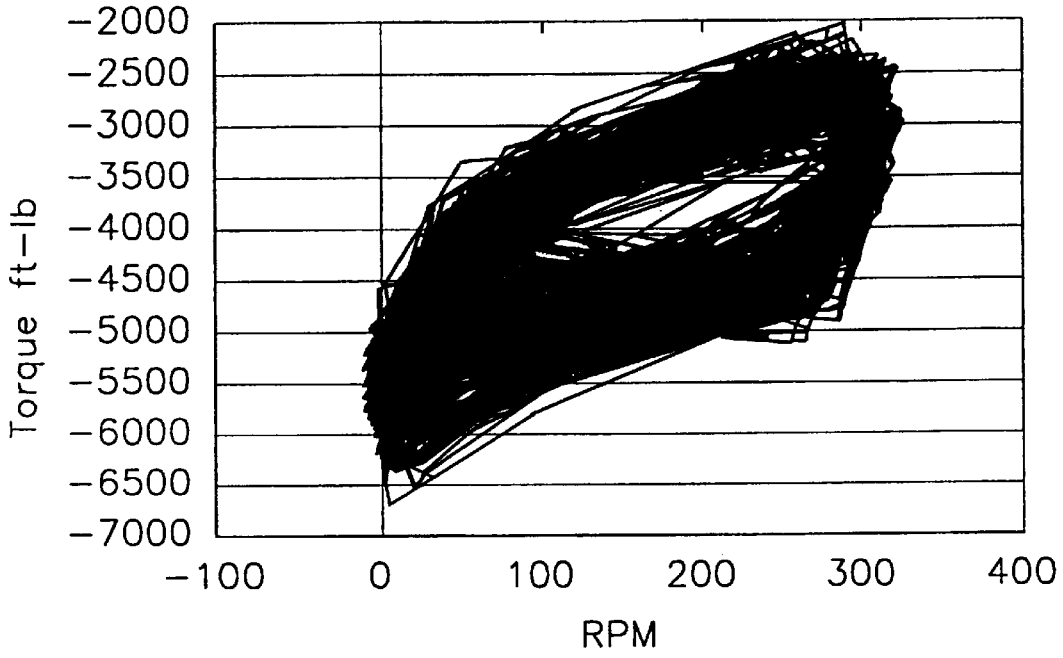
FIG. 6 is a similar plot to FIG. 5 under different drilling conditions.

Appropriate analysis of surface torque may also provide other information regarding downhole conditions. For example, FIGS. 5 and 6 show plots, from measurements taken downhole, of the relationship between RPM and torque during drilling. It will be seen that each plot is generally in the form of a loop indicating an hysteresis effect. It is believed that the oscillatory behaviour of the drilling system which is represented by such plots may be at least partly dependent on the nature of the formation through which the drill bit is drilling at the time. Thus, the plot of FIG. 5 was acquired when the drill bit was drilling through Burgess sandstone whereas the plot of FIG. 6 was derived when drilling softer formation of shale/Burgess sandstone.

FIG. 7 again shows the relationship between torque and RPM, but in this case in a series of tests drilling through different types of formation, the plots for the different tests being superimposed.

The main part of the graph, where the plot comprises a series of loops, as indicated at 21, the bit was drilling through relatively hard formations such as limestone and sandstone. However, when drilling through shale, a softer formation, the plot of torque against RPM is of an entirely different configuration, as indicated at 22 in FIG. 7. Here, at about 150 RPM, the torque varies only over a small range at about −500 ft-lb.

The possibility therefore arises of using information regarding the torque vibration of the bottomhole assembly for the purpose of inferring the nature of the formation through which the drill is drilling.

Figure 7:
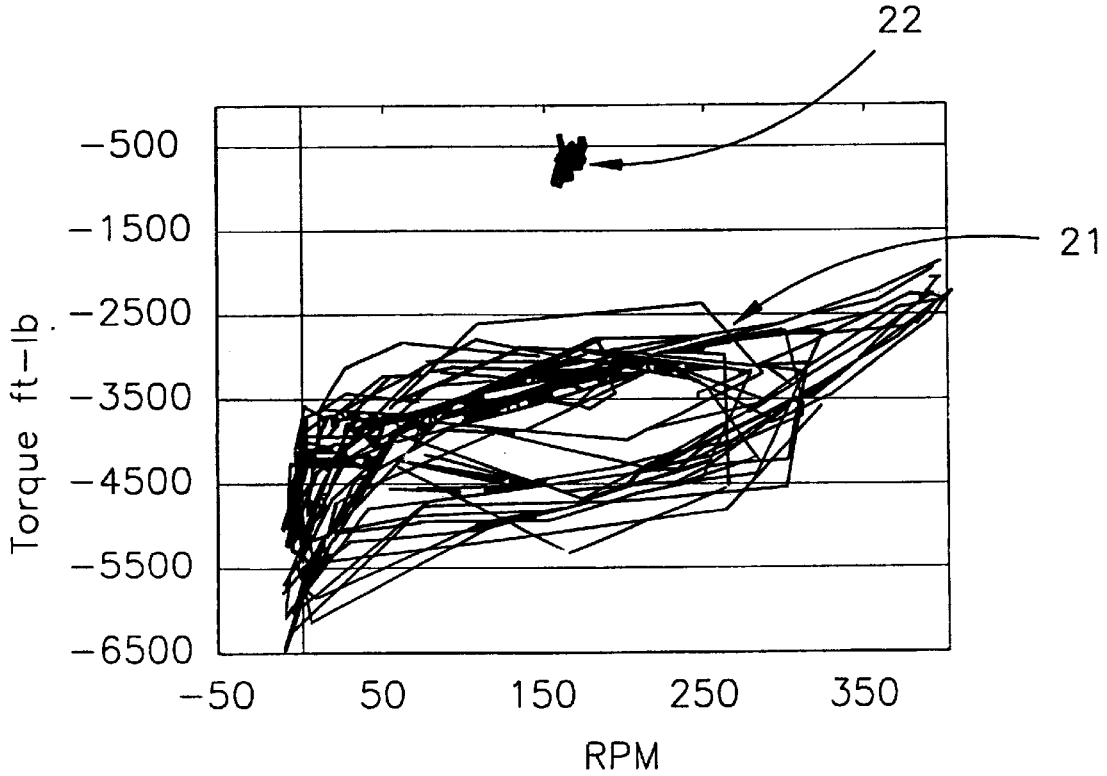
FIG. 7 shows the relationship between torque and RPM in a series of test drilling, with the same bit, through different types of formation.

The particular data incorporated in the graphs of FIGS. 5 to 7 generally cannot be obtained from surface measurements. However, it is believed that information as to the nature of the formation being drilled can be obtained from the spectral density function, as shown for a example in FIG. 4. The characteristics of the spectral density function may be used to indicate the nature of the formation currently being drilled. Monitoring the torsional vibration of the bottomhole assembly from surface measurements, as previously described, may therefore provide a guide as to when the drill bit has reached a payzone.

The invention has been particularly described in relation to the detection of torsional vibration in a bottomhole assembly, and this is where the invention may be particularly useful. However, it will be appreciated that the principle of the invention may also be applied to the detection, at the surface, of vibration in other downhole assemblies or components.

Whereas the present invention has been described in particular relation to the drawings attached hereto, it should be understood that other and further modifications, apart from those shown or suggested herein, may be made within the scope and spirit of the present invention.

What is claimed:

1. A method of detecting torsional vibration in a bottomhole assembly mounted on a drill string of a rotary drilling system for drilling in an earth formation, the method including the steps of:

(a) ascertaining natural frequencies of torsional vibration of the bottomhole assembly prior to drilling, (b) noting at least one reference frequency for an integer wavelength mode of torsional vibration of the bottomhole assembly, and (c) during subsequent drilling, where a drill string torque results from said rotary drilling done below a well surface, monitoring the drill string torque at or near the surface for a bandwidth around said reference frequency.

2. A method according to claim 1, wherein the natural frequencies of torsional vibration of the bottomhole assembly are ascertained by use of a computer program which determines the natural frequencies of an assembly from input of parameters of the assembly selected from: dimensions, mass, rotary inertia and flexibility of the assembly or components thereof; or that said natural frequencies are ascertained be ascertained by physical testing of the actual bottomhole assembly itself.

3. A method according to claim 1, wherein the natural frequencies of torsional vibration of the bottomhole assembly are ascertained by physical testing of the actual bottomhole assembly itself.

4. A method according to claim 1, wherein the monitoring of the surface torque of the drill string is effected by coupling a surface, torque sensor to the drill string and transmitting the output signal from the torque sensor to a computer which has been programmed to analyze the signal and produce an output indicating variation of the torque for a bandwidth around the aforesaid pre-ascertained reference frequency of the bottomhole assembly, said reference frequency having previously been input as a parameter into the signal analyzing program of the computer.

5. A method according to claim 4, wherein the output signal from the surface torque sensor is digitally sampled by the computer program for a succession of short periods.

6. A method according to claim 5, wherein the output signal is sampled at a rate of at least 300 Hz.

7. A method according to claim 5, wherein the output signal is an analogue signal and is digitized before being transmitted to the computer.

8. A method according to claim 5, including the further step of producing a spectral density function from each sampled signal, identifying the a part of the function lying within a selected narrow bandwidth around said reference frequency of the bottomhole assembly, and monitoring said part of the function over time.

9. A method according to claim 8, including the step of identifying the area under the function lying within a selected narrow bandwidth around said reference frequency of the bottomhole assembly, and monitoring the value of said area over time.

10. A method according to claim 9, wherein the area of the spectral density function within the selected bandwidth is plotted against time on a visual output from the computer.

11. Apparatus for detecting torsional vibration in a bottomhole assembly mounted on a drill string of a rotary drilling system for drilling in an earth formation, below a well surface comprising a surface torque sensor for coupling to the drill string at or near the surface, and means for transmitting an output signal from the torque sensor to a computer, the computer being programmed to analyze the signal and produce an output indicating variation of the mean square torque for a bandwidth around a reference frequency previously input as a parameter into the signal analyzing program of the computer.

12. Apparatus according to claim 11, wherein the output signal transmitted from the torque sensor to the computer is an analogue torque signal, and an analogue-digital converter is provided to digitize said output signal and transmit a corresponding digital signal to the computer.

* * * * *